US011136732B2

(12) United States Patent
Sondreal et al.

(10) Patent No.: US 11,136,732 B2
(45) Date of Patent: Oct. 5, 2021

(54) MILLING MACHINE HAVING PIVOT ARMS OFFSET FROM ENGINE OUTPUT SHAFT

(71) Applicant: CATERPILLAR PAVING PRODUCTS INC., Brooklyn Park, MN (US)

(72) Inventors: Dustin W. Sondreal, Hanover, MN (US); Brian J. Schlenker, Shoreview, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/774,249

(22) Filed: Jan. 28, 2020

(65) Prior Publication Data

US 2021/0230819 A1 Jul. 29, 2021

(51) Int. Cl.

| | |
|---|---|
| ***E01C 23/088*** | (2006.01) |
| ***E01C 23/12*** | (2006.01) |
| ***E01C 23/06*** | (2006.01) |
| *E02F 3/78* | (2006.01) |

(52) U.S. Cl.

CPC ..... *E01C 23/088* (2013.01); *E01C 23/065* (2013.01); *E01C 23/127* (2013.01); *E02F 3/783* (2013.01)

(58) Field of Classification Search

CPC ..... E01C 23/08; E01C 21/00; E01C 23/065; E01C 23/088; E01C 23/127; E02F 3/188; E02F 3/783; E02F 3/181; E02F 3/183; E02F 3/20; E02F 3/205; E02F 3/22; E02F 3/24; E02F 3/246; E02F 3/8155

See application file for complete search history.

(56) References Cited

U.S. PATENT DOCUMENTS

| | | | | |
|---|---|---|---|---|
| 2,424,459 | A | 7/1947 | Hettelsater | |
| 3,732,023 | A * | 5/1973 | Rank | E01C 23/121 404/90 |
| 3,907,038 | A | 9/1975 | Nelson | |
| 4,411,081 | A * | 10/1983 | King | E02D 3/032 37/903 |
| 5,060,732 | A * | 10/1991 | Baskett | A01B 43/00 171/63 |
| 5,190,398 | A | 3/1993 | Swisher, Jr. | |
| 5,354,147 | A | 10/1994 | Swisher, Jr. | |

(Continued)

*Primary Examiner* — Janine M Kreck
*Assistant Examiner* — Michael A Goodwin
(74) *Attorney, Agent, or Firm* — Finnegan, Henderson, Farabow, Garrett & Dunner, LLP

(57) ABSTRACT

A milling machine may include a frame. The milling machine may include a first wheel and a second wheel connected to a first end of the frame, and a third wheel connected to a second end of the frame. The milling machine may include a first leg, a second leg, and a third leg connecting the frame and the first wheel, the second wheel, and the third wheel, respectively. The milling machine may include a pair of arms pivotably connected to opposite sides of the frame. The milling machine may have a milling drum rotatably connected to the arms with a rotational axis parallel to the pivot axis. Further, the milling machine may have an engine that rotates the milling drum via a transmission. An output shaft of the engine positioned transverse to the frame may have an output shaft axis spaced apart from the pivot axis of the arms.

20 Claims, 7 Drawing Sheets

(56) References Cited

U.S. PATENT DOCUMENTS

| | | | | |
|---|---|---|---|---|
| 5,893,677 | A * | 4/1999 | Haehn | E01C 23/065 404/90 |
| 7,918,512 | B2 | 4/2011 | Mannebach et al. | |
| 8,075,063 | B2 | 12/2011 | Mannebach et al. | |
| 8,840,191 | B2 | 9/2014 | Mannebach et al. | |
| 9,068,304 | B2 | 6/2015 | Mannebach et al. | |
| 2007/0116519 | A1* | 5/2007 | Haroldsen | E01C 23/088 404/94 |
| 2008/0246328 | A1* | 10/2008 | Mannebach | E01C 23/127 299/39.6 |
| 2011/0298188 | A1* | 12/2011 | Haubrich | E01C 23/01 280/6.155 |
| 2014/0375110 | A1* | 12/2014 | Mannebach | E01C 23/065 299/39.6 |
| 2016/0160454 | A1* | 6/2016 | Berning | E01C 23/088 299/1.05 |
| 2018/0023260 | A1* | 1/2018 | Muir | E01C 21/00 404/84.05 |

* cited by examiner

MILLING MACHINE HAVING PIVOT ARMS OFFSET FROM ENGINE OUTPUT SHAFT

TECHNICAL FIELD

The present disclosure relates generally to a milling machine and, more particularly, to a milling machine having pivot arms offset from engine output shaft.

BACKGROUND

Road surfaces typically include an uppermost layer of asphalt or concrete on which vehicles travel. Over time, a road surface may wear out or may be damaged, for example, due to the formation of potholes or development of cracks and ruts. The damaged road surface may in turn cause damage to vehicles travelling on the road surface. The damaged road surface can be repaired locally by filling up the potholes, cracks, and/or ruts. However, it is often desirable to replace the worn or damaged road surface with an entirely new road surface. This is usually accomplished by removing a layer of the asphalt or concrete from the roadway and repaving the roadway by laying down a new layer of asphalt or concrete.

It is sometimes desirable to stabilize or reconstitute the upper layer of a roadway or a worksite (e.g. parcel of land, parking lot, building site, etc.). This is usually accomplished by removing the upper layer, mixing it with stabilizing components such as cement, ash, lime, etc., and depositing the mixture back on top of the roadway or worksite. A milling machine, such as a stabilizer or reclaimer is often used for this purpose. Such milling machines include a frame supported by wheels or tracks and include a milling drum attached to the frame. The milling drum is enclosed in a drum chamber. The cutting tools or teeth on the milling drum tear up the ground and push the removed material toward a rear of the drum chamber. Stabilizing ingredients and/or water are mixed with the milled material, which is then deposited back on to the ground towards the rear of the drum chamber.

In some stabilizers or reclaimers, the milling drum is not directly attached to the frame. Instead the milling drum is attached to a pair of arms, which pivot about the frame. Hydraulic actuators positioned between the arms and the frame are provided to raise or lower the arms to change a position of the milling drum relative to the frame and to the ground. It is desirable to arrange the engine on the frame of such milling machines such that rotational power may be transmitted from the engine directly to the milling drum via a belt or chain drive. Some reclaimer designs position the engine output shaft coaxially with the pivot axis of the pivot arms. Such an arrangement, however, poses significant design, manufacturing, and maintenance challenges.

The milling machine of the present disclosure solve one or more of the problems set forth above and/or other problems of the prior art.

SUMMARY

In one aspect, the present disclosure is directed to a milling machine. The milling machine may include a frame. The milling machine may also include a first wheel and a second wheel connected to a first end of the frame. Further, the milling machine may include a third wheel connected to a second end of the frame disposed opposite the first end. The milling machine may include a first leg connecting the frame and the first wheel, a second leg connecting the frame and the second wheel, and a third leg connecting the frame and the third wheel. The milling machine may also include a pair of arms pivotably connected to opposite sides of the frame. The arms may have a common pivot axis disposed transverse to the frame. The milling machine may have a milling drum rotatably connected to free ends of the pair of arms. A rotational axis of the milling drum may be disposed generally parallel to the pivot axis. The milling machine may also have an engine configured to rotate the milling drum via a transmission. The engine may have an output shaft positioned generally transverse to the frame. The output shaft may have an output shaft axis disposed spaced apart from the pivot axis of the arms. The pivot axis may be disposed between the output shaft axis and the rotational axis of the milling drum.

In another aspect, the present disclosure is directed to a milling machine. The milling machine may have a frame. The milling machine may have a left front wheel disposed adjacent a front end of the frame and a right front wheel disposed adjacent the front end and spaced apart from the left front wheel. Further, the milling machine may have a left rear wheel disposed adjacent a rear end of the frame and a right rear wheel disposed adjacent the rear end and spaced apart from the left rear wheel. The milling machine may also have a left front leg connecting the frame and the left front wheel, a right front leg connecting the frame and the right front wheel, a left rear leg connecting the frame and the left rear wheel, and a right rear leg connecting the frame the right rear wheel. The milling machine may have a left arm pivotably connected to the frame and extending from the frame towards the front end of the frame. The milling machine may also have a right arm pivotably connected to the frame and extending from the frame towards the front end of the frame. The left arm and the right arm may have a common pivot axis disposed transverse to the frame. The milling machine may have a cross tube connecting the left arm and the right arm, and at least one actuator connecting the frame and the cross tube. The milling machine may also have a milling drum rotatably connected to free ends of the left and right arms. Additionally, the milling machine may have an engine disposed transverse to the frame. The engine may have an output shaft configured to rotate the milling drum via a belt drive. An output shaft axis of the output shaft may be disposed parallel to and spaced apart from the pivot axis of the arms. The pivot axis may be disposed between the output shaft axis and the rotational axis of the milling drum.

DETAILED DESCRIPTION

Figure 1:
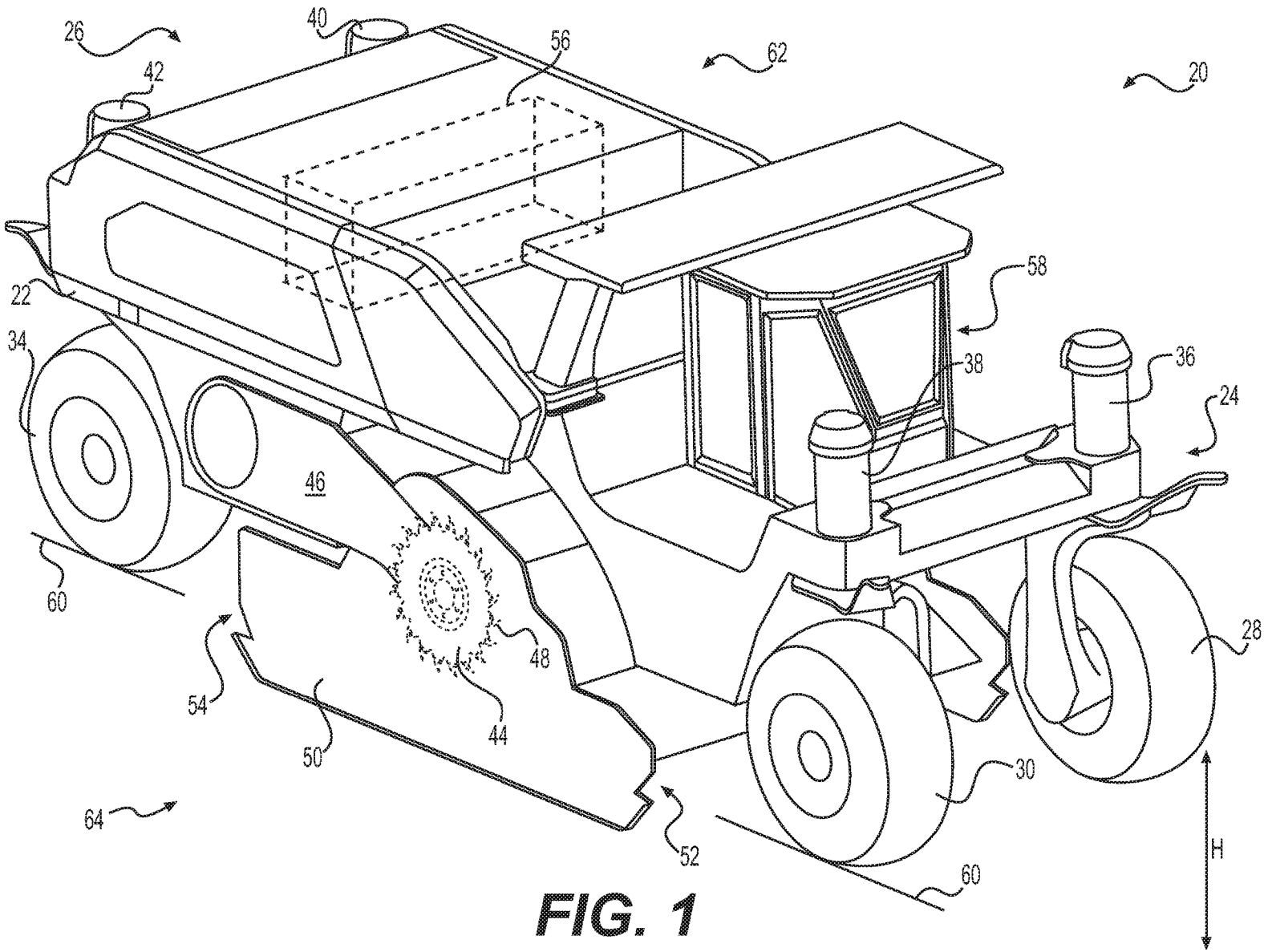
FIG. 1 is an illustration of an exemplary milling machine.

FIG. 1 illustrates an exemplary milling machine 20, respectively. In one exemplary embodiment as illustrated in FIG. 1, milling machine 20 may be a reclaimer, which may also be called soil stabilizer, reclaiming machine, road reclaimer, etc. Milling machine 20 may include frame 22, which may extend from first end 24 to second end 26 disposed opposite first end 24. In some exemplary embodiments, first end 24 may be a front end and second end 26 may be a rear end of frame 22. Frame 22 may have any shape (e.g. rectangular, triangular, square, etc.)

Frame 22 may be supported on one or more propulsion devices 28, 30, 32 (not visible in FIG. 1), 34. Propulsion devices 28, 30, 32, 34 may be equipped with electric or hydraulic motors which may impart motion to propulsion devices 28, 30, 32, 34 to help propel machine 20 in a forward or rearward direction. In one exemplary embodiment as illustrated in FIG. 1, propulsion devices 28, 30, 32, 34 may take the form of wheels. It is contemplated, however, that propulsion devices 28, 30, 32, 34 of milling machine 20 may take the form of tracks, which may include, for example, sprocket wheels, idler wheels, and/or one or more rollers that may support a continuous track. In the present disclosure, the terms wheel and track will be used interchangeably and will include the other of the two terms.

Wheels 28, 30 may be located adjacent first end 24 of frame 22 and wheels 32, 34 may be located adjacent second end 26 of frame 22. Wheel 28 may be spaced apart from wheel 30 along a width direction of frame 22. Likewise, wheel 32 may be spaced apart from wheel 34 along a width direction of frame 22. In one exemplary embodiment as illustrated in FIG. 1, wheel 28 may be a left front wheel, wheel 30 may be a right front wheel, wheel 32 may be a left rear wheel, and wheel 34 may be a right rear wheel. Some or all of propulsion devices 28, 30, 32, 34 may also be steerable, allowing machine 20 to be turned towards the right or left during a forward or rearward motion on ground surface 60. Although milling machine 20 in FIG. 1 has been illustrated as including four wheels 28, 30, 32, 34, it is contemplated that in some exemplary embodiments, milling machine 20 may have only one rear wheel 32 or 34, which may be located generally centered along a width of frame 22.

Frame 22 may be connected to wheels 28, 30, 32, 34 by one or more legs 36, 38, 40, 42. For example, as illustrated in FIG. 1, frame 22 may be connected to left front wheel 28 via leg 36 and to right front wheel 30 via leg 38. Likewise, frame 22 may be connected to left rear wheel 32 via leg 40 and to right rear wheel 34 via leg 42. One or more of legs 36, 38, 40, 42 may be height adjustable such that a height of frame 22 relative to one or more of wheels 28, 30, 32, 34 may be increased or decreased by adjusting a length of one or more of legs 36, 38, 40, 42, respectively. It will be understood that adjusting a height of frame 22 relative to one or more of wheels 28, 30, 32, 34 would also adjust a height of frame 22 relative to ground surface 60 on which wheels 28, 30, 32, 34 may be supported.

Milling drum 44 of milling machine 20 may be located between first end 24 and second end 26. It is to be understood that the term milling drum includes terms such as drum, cutting drum, working drum, mixing drum, etc. In one exemplary embodiment as illustrated in FIG. 1, milling drum 44 of milling machine 20 may not be directly attached to frame 22. Instead, as illustrated in FIG. 1 milling drum 44 of milling machine 20 may be attached to frame 22 via arms 46. Arms 46 may include a pair of arms (only one of which is visible in FIG. 1) disposed on either side of milling machine 20. As also illustrated in FIG. 1, arms 46 may extend from frame 22 towards front end 24 of frame 22. It is contemplated, however, that in other exemplary embodiments of milling machine 20, arms 46 may extend from frame 22 towards rear end 26 of frame 22. Milling drum 44 may be attached to free ends of arms 46. Milling drum 44 of milling machine 20 may include cutting tools 48 (or teeth 48).

A height of milling drum 44 above the ground surface may be adjusted by rotating arms 46 relative to frame 22 and/or by adjusting one or more of legs 36, 38, 40, 42. As milling drum 44 rotates, teeth 48 may come into contact with and tear or cut the ground or roadway surface. Milling drum 44 may be enclosed within drum chamber 50 which may help contain the material removed by teeth 48 from the ground or roadway surface. Rotation of milling drum 44 may cause the removed material to be transferred from adjacent front end 52 of drum chamber 50 towards rear end 54 of drum chamber 50. It is also contemplated that in some exemplary embodiments, rotation of milling drum 44 may cause the removed material to instead be transferred from adjacent rear end 54 of drum chamber 50 towards front end 52 of drum chamber 50. Stabilizing components such as ash, lime, cement, water, etc. may be mixed with the removed material and the reconstituted mixture of the milled material and the stabilizing components may be deposited on ground surface 60 adjacent rear end 54 of drum chamber 50.

Milling machine 20 may also include engine 56 and operator platform 58. Engine 56 may be any suitable type of internal combustion engine, such as a gasoline, diesel, natural gas, or hybrid-powers engine. It is contemplated, however, that in some exemplary embodiments, engine 56 may be driven by electrical power. Engine 56 may be configured to deliver rotational power output to one or more hydraulic motors associated with propulsion devices 28, 30, 32, 34, and to milling drum 44. Engine 56 may also be configured to deliver power to operate one or more other components or accessory devices (e.g. pumps, fans, motors, generators, belt drives, transmission devices, etc.) associated with milling machine 20.

Milling machine 20 may include operator platform 58, which may be attached to frame 22. In some exemplary embodiments, operator platform 58 may be in the form of an open-air platform that may or may not include a canopy. In other exemplary embodiments, operator platform 58 may be in the form of a partially or fully enclosed cabin. Operator platform 58 may include one or more control or input devices that may be used by an operator of machine 20 to control operations of machine 20. As illustrated in FIG. 1, operator platform 58 may be located at a height "H" above ground surface 60. In some exemplary embodiments, height H may range between about 2 ft to 10 ft above ground surface 60. Although operator platform 58 is illustrated in FIG. 1 as positioned generally midway about a width of machine 20, operator platform 58 may be configured to be positioned at different positions along the width of frame 22. Thus, for example, operator platform 58 may be configured to be movable from adjacent left side 62 of frame 22 to adjacent right side 64 of frame 22.

It will be understood that as used in this disclosure the terms front and rear are relative terms, which may be determined based on a direction of travel of milling machine 20. Likewise, it will be understood that as used in this disclosure, the terms left and right are relative terms, which may be determined based on facing the direction of travel of milling machine 20.

Figure 2:
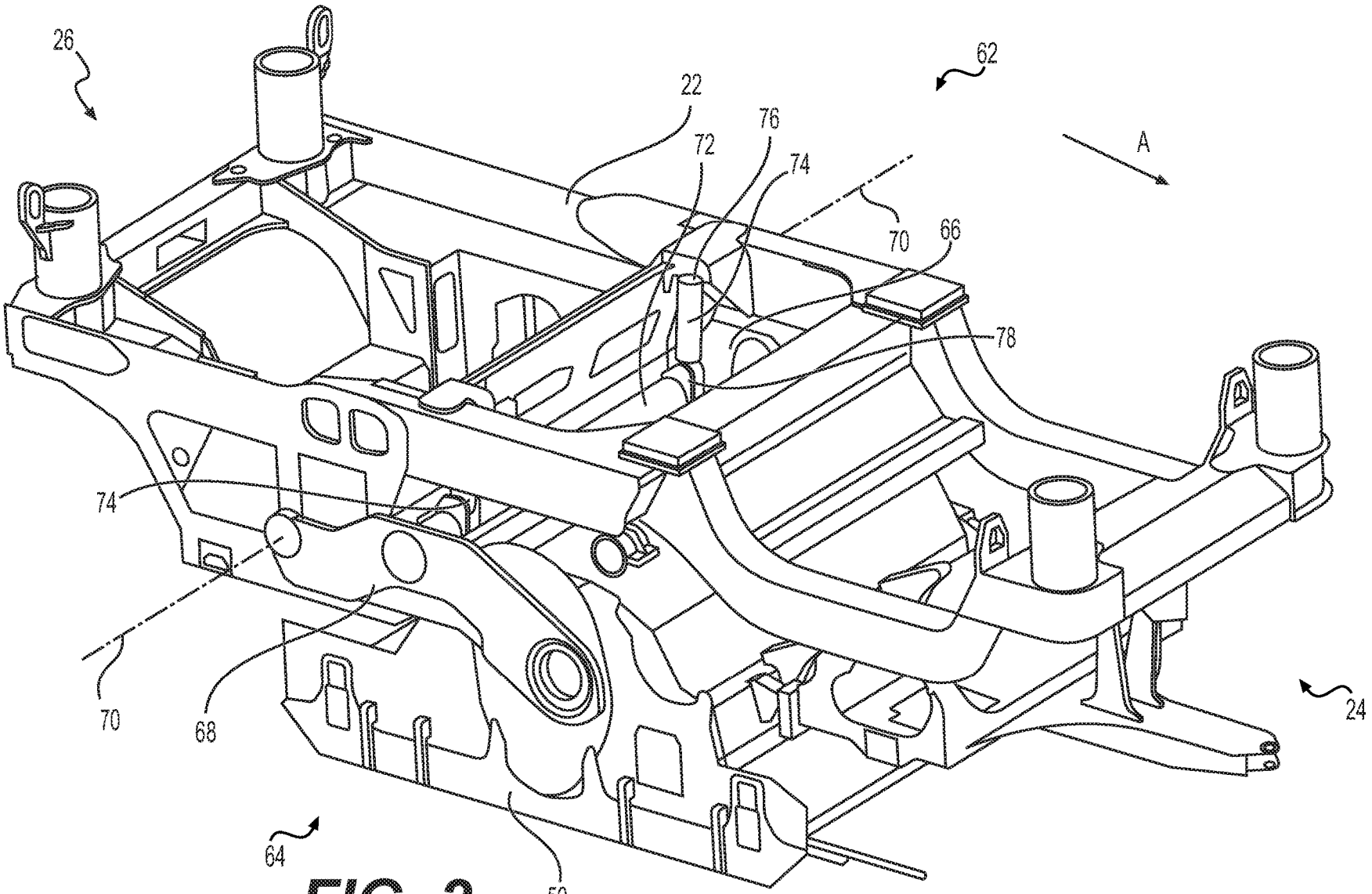
FIG. 2 is a partial view illustration of the exemplary milling machine of FIG. 1.

FIG. 2 illustrates a partial view of an exemplary milling machine 20. As illustrated in FIG. 2, arms 46 may include left arm 66 and right arm 68. Left arm 66 may be disposed on left side 62 of frame 22, and right arm 68 may be disposed on right side 64 of frame 22. Left and right arms 66, 68 may be pivotably attached to frame 22 and may be configured to be rotatable relative to frame 22. Left arm 66 and right arm 68 may have a common pivot axis 70 disposed transverse to frame 22 and generally parallel to a width direction of frame 22. Cross tube 72 may be fixedly connected at one end to left arm 66 and at an opposite end to right arm 68. One or more arm actuators 74 may be connected between frame 22 and cross tube 72. For example, one end 76 of arm actuator 74 may be connected to frame 22 and an opposite end 78 of arm actuator 74 may be connected to cross tube 72. In one exemplary embodiment, arm actuators 74 may be single-acting or double-acting hydraulic actuators. It is contemplated, however, that arm actuators 74 may be single-acting or double-acting pneumatic actuators or may include a rack and pinion arrangement, a belt and pulley arrangement, etc.

Figure 3:
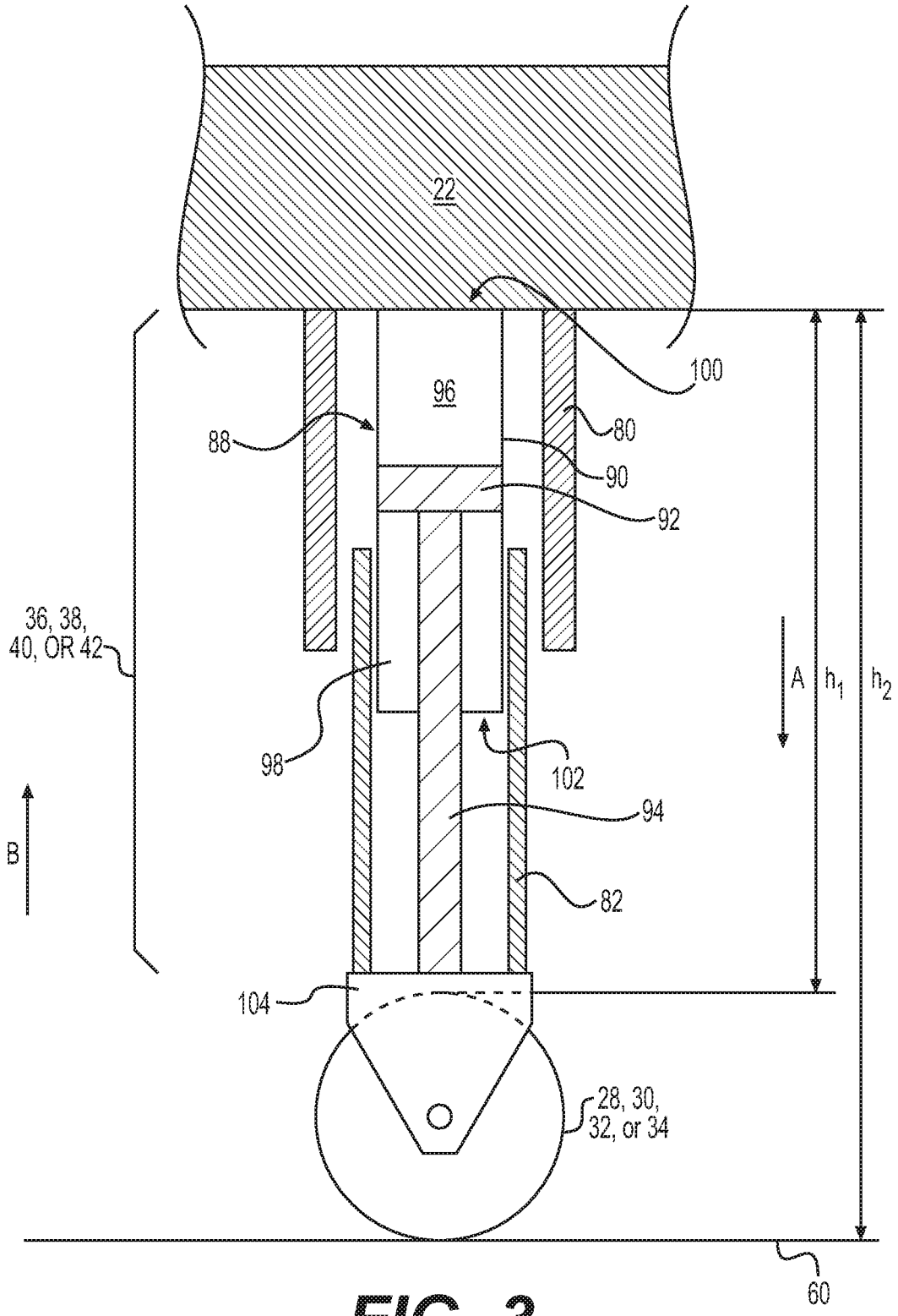
FIG. 3 is a partial cross-section view illustration of an exemplary leg for the milling machine of FIG. 1.

FIG. 3 is a partial cross-sectional view illustration of an exemplary leg 36, 38, 40, 42 for milling machine 20. Leg 36 may include first (or upper) section 80 and second (or lower) section 82. Actuator 88 may be disposed within or outside leg 36. First section 80 may be attached to frame 22. In one exemplary embodiment, first section 80 may be rigidly attached to frame 22. First section 80 may extend from frame 22 towards wheel 28. In some exemplary embodiments, first section 80 may also extend into frame 22 in a direction away from wheel 28. Second section 82 may be attached to wheel 28 and may extend from wheel 28 toward frame 22. In one exemplary embodiment as illustrated in FIG. 3, first and second sections 80, 82 may be hollow cylindrical tubes. It is contemplated, however, that first and second sections 80, 82 may have other non-cylindrical shapes. First and second sections 80, 82 may be configured to slidably move relative to each other. In one exemplary embodiment as illustrated in FIG. 3, second section 82 may have a smaller cross-section relative to first section 80 and may be received within first section 80. It is contemplated, however, that in other exemplary embodiments, first section 80 may have a smaller cross-section relative to second section 82 and may be received within second section 82. First and second sections 80, 82 may form a variable height enclosure within which actuator 88 may be located. It is also contemplated, however, that actuator 88 may be located outside the enclosure formed by first and second sections 80, 82.

Actuator 88 may connect frame 22 with wheel 28. Actuator 88 may include cylinder 90, piston 92, and rod 94. Cylinder 90 may extend from frame end 100 connected to frame 22 to wheel end 102 which may be disposed between frame 22 and wheel 28. Piston 92 may be slidably disposed within cylinder 90 and may divide cylinder 90 into head-end chamber 96 and rod-end chamber 98. That is, piston 92 may be configured to slide within cylinder 90 from adjacent frame end 100 to adjacent wheel end 102. Head-end chamber 96 may be disposed nearer frame end 100 of cylinder 90 and rod-end chamber 98 may be disposed nearer wheel end 102 of cylinder 90. Rod 94 may be connected at one end to piston 92. Rod 94 may extend from piston 92, through wheel end 102 of cylinder 90, and may be directly or indirectly connected at an opposite end of rod 94 to wheel 28. In one exemplary embodiment as illustrated in FIG. 3, rod 94 may be connected to yoke 104, which in turn may be connected to wheel 28. In some exemplary embodiments, yoke 104 may be fixedly attached to second section 82 of leg 36. In these exemplary embodiments, rod 94 may be connected to second section 82 of leg 36. In other exemplary embodiments, yoke 104 may be a part of wheel 28 and may be movably attached to second section 82. It is also contemplated that in some embodiments, yoke 104 may not be attached to second section 82. It is further contemplated that yoke 104 may not be present in some exemplary embodiments and wheel 28 may be directly connected to second section 82 of leg 36.

Actuator 88 may be a single-acting or double-acting hydraulic actuator. For example, one or both of head-end chamber 96 and rod-end chamber 98 of actuator 88 may be configured to receive and hold hydraulic fluid. One or both of head-end chamber 96 and rod-end chamber 98 may be connected to a tank (not shown) configured to store hydraulic fluid. Filling head-end chamber 96 with hydraulic fluid and/or emptying hydraulic fluid from rod-end chamber 98 may cause piston 92 to slidably move within cylinder 90 in a direction shown by arrow "A" from frame end 100 toward wheel end 102. Piston movement in direction A may result in an increase in a length of actuator 88, causing first and second sections 80 and 82 to slidably move relative to each other thereby increasing a height "$h_1$" of leg 36. Height $h_1$ may also correspond to a height of frame 22 relative to wheel 28. An increase in height $h_1$ may correspond with an increase in height "$h_2$" of frame 22 relative to ground surface 60. Similarly, emptying hydraulic fluid from head-end chamber 96 and/or filling rod-end chamber 98 with hydraulic fluid may cause piston 92 to slidably move within cylinder 90 in a direction shown by arrow "B" from wheel end 102 towards frame end 100. Piston movement in direction B may decrease the length of actuator 88 thereby decreasing a height "$h_1$" of leg 36, which in turn may decrease a height "$h_2$" of frame 22 relative to ground surface 60. Furthermore, although the above description refers to leg 36 and wheel 28, each of legs 38, 40, 42 connected between frame 22 and wheels 30, 32, 34, respectively, may have structural and functional characteristics similar to those described above with respect to leg 36 and wheel 28.

Figure 4:
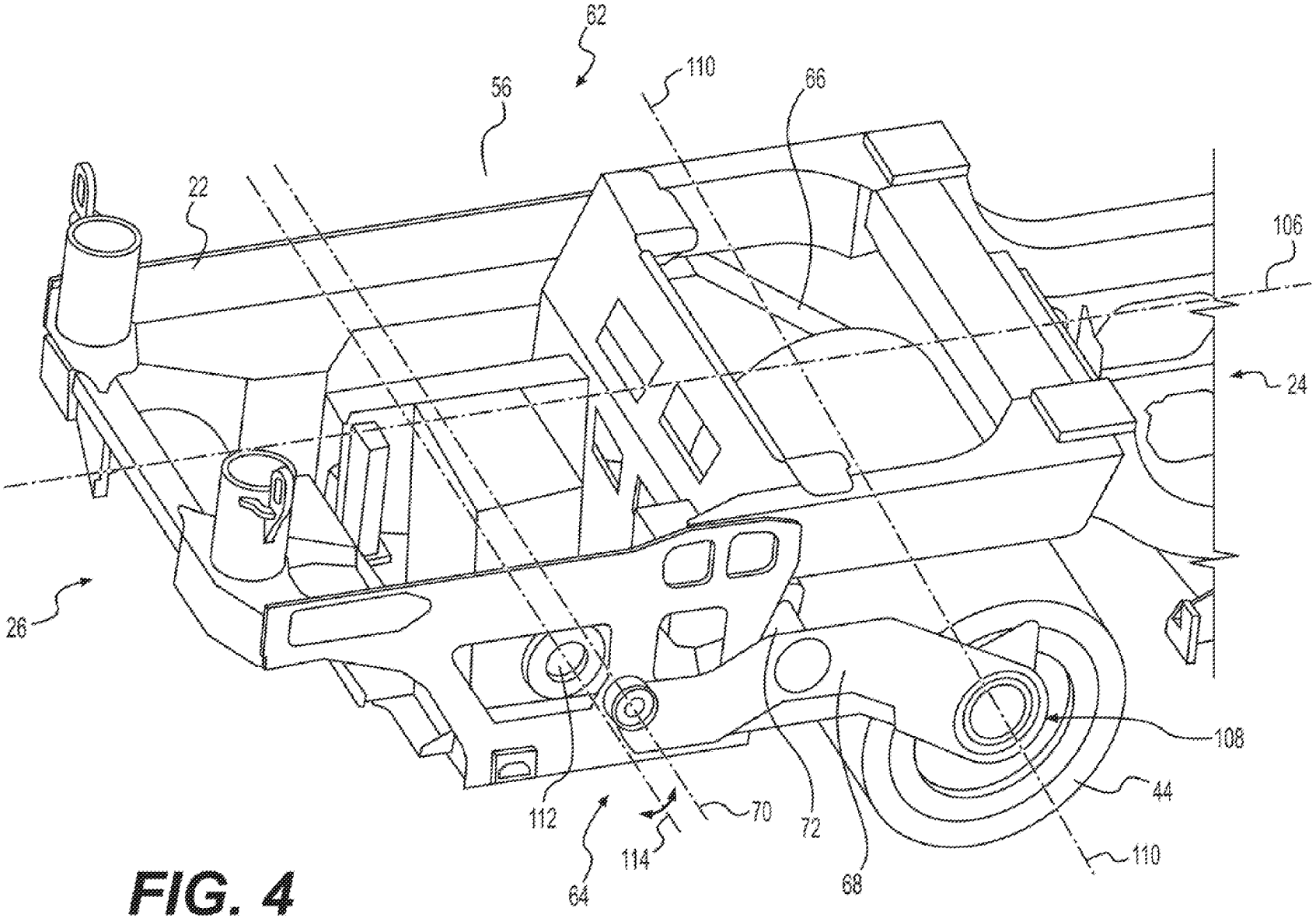
FIG. 4 is another partial view illustration of the exemplary milling machine of FIG. 1.

FIG. 4 illustrates another partial view of an exemplary milling machine 20. As illustrated in FIG. 4, frame 22 of machine 20 may have a longitudinal axis 106 extending in a forward-rearward direction from front end 24 towards rear end 26. As discussed above, left and right arms 66, 68 may be pivotably connected to frame 22 and may be configured to pivot about a common pivot axis 70 disposed transverse to frame 22. For example, pivot axis 70 may be disposed generally perpendicular to longitudinal axis 106 and generally parallel to a width direction of frame 22. Left and right arms 66, 68 may extend from frame 22. Milling drum 44 may be rotatably attached to free ends 108 of left and right arms 66, 68. Milling drum 44 may include one or more teeth 48 (not shown in FIG. 4 for simplicity). Milling drum 44 may rotate about rotational axis 110 which may be disposed transverse to frame 22. For example, rotational axis 110 of milling drum 44 may be disposed generally perpendicular to longitudinal axis 106 and generally parallel to pivot axis 70 of left and right arms 66,68. As used in this disclosure the term "generally" should be interpreted as encompassing typical manufacturing and assembly tolerances. For example, the term "generally perpendicular" should be interpreted as encompassing angles in the range of 90°±5°.

Likewise, the term "generally parallel" should be interpreted as encompassing angles in the range of 0°±5°.

As illustrated in FIG. 4, engine 56 may be mounted to frame 22 and may be positioned transversely on frame 22. Engine 56 may be arranged along a width of frame 22. In one exemplary embodiment, engine 56 may be positioned so that output shaft 112 of engine 56 may be disposed generally perpendicular to longitudinal axis 106 of frame 22. Output shaft 112 of engine 56 may be directly or indirectly connected to a crankshaft associated with engine 56. Output shaft 112 of engine 56 may rotate about output shaft axis 112, which may be disposed generally perpendicular to longitudinal axis 106 and generally parallel to pivot axis 70. It is contemplated, however, that in some exemplary embodiments, output shaft 112 and output shaft axis 112 may instead be disposed generally inclined (e.g. at angles ranging between 5° to 30°) relative to pivot axis 70 and/or rotational axis 110 of milling drum 44. As also illustrated in FIG. 4, output shaft axis 112 of engine 56 may be spaced apart from pivot axis 70.

Figure 5A:
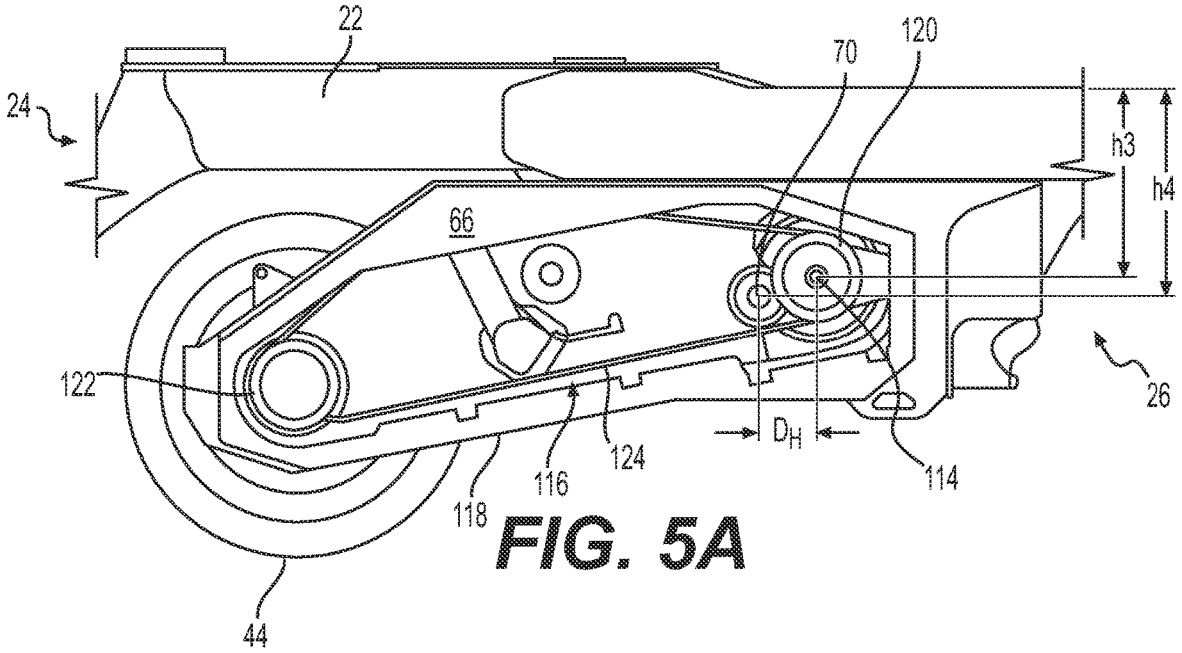
FIG. 5A is a partial view illustration of a left side of the exemplary milling machine of FIG. 1.

FIG. 5A illustrates a partial view of left side 62 of machine 20, showing a position of pivot axis 70 relative to output shaft axis 114. As illustrated in FIG. 5A, pivot axis 70 may be spaced apart from output shaft axis 114 in both horizontal and vertical directions. For example, pivot axis 70 may be positioned forward (i.e. nearer front end 24) of output shaft axis 114 by a horizontal distance "Mi." In one exemplary embodiment illustrated in FIG. 5A, output shaft axis 114 may be positioned at a height "$h_3$" relative to frame 22 and pivot axis 70 may be positioned at a height "$h_4$" relative to frame 22. As also shown in FIG. 5A, height $h_3$ may be smaller than height $h_4$ so that pivot axis 70 may be positioned vertically lower (i.e. nearer ground surface 60) than output shaft axis 114.

Machine 20 may include transmission 116 for transferring motive power from engine 56 to milling drum 44. As illustrated in FIG. 5A, left arm 66 may include transmission casing 118 which may enclose transmission 116. Although FIG. 5A illustrates left arm 66 as including transmission casing 118, it is contemplated that in some exemplary embodiments, additionally or alternatively, right arm 68 may include transmission casing 118. Transmission 116 may be a belt drive transmission that may include engine-driven pulley 120, drum pulley 122, and one or more belts 124. Engine-driven pulley 120 may be directly or indirectly connected to output shaft 112. In some exemplary embodiments, engine-driven pulley 120 may include an axle that may be connected to output shaft 112 via, for example, an articulated joint or gear box that may allow output shaft 112 and output shaft axis 114 to be inclined relative to pivot axis 70. In other exemplary embodiments, the axle of engine-driven pulley 120 may be coaxial with output shaft axis 114 and/or engine-driven pulley 120 may be directly attached to output shaft 112 of engine 56.

Drum pulley 122 may be directly or indirectly connected to milling drum 44. In some exemplary embodiments, drum pulley 122 may be directly attached to milling drum 44. In other exemplary embodiments, drum pulley 122 may be connected to a planetary gear mechanism disposed within milling drum 44. One or more continuous, never-ending belts 124 may connect engine-driven pulley 120 and drum pulley 122. For example, as illustrated in FIG. 5A, belt 124 may loop around engine-driven pulley 120 and drum pulley 122. Output shaft 112 of engine 56 may rotate engine-driven pulley 120 via a clutch (not shown). Engine-driven pulley 120 in turn may rotate drum pulley 122 via the one or more belts 124. Drum pulley 122 may rotate milling drum 44 either directly or via the planetary gear box in milling drum 44. Transmission 116 may advantageously allow efficient transfer of motive power from engine 56 to milling drum 44.

Figure 5B:
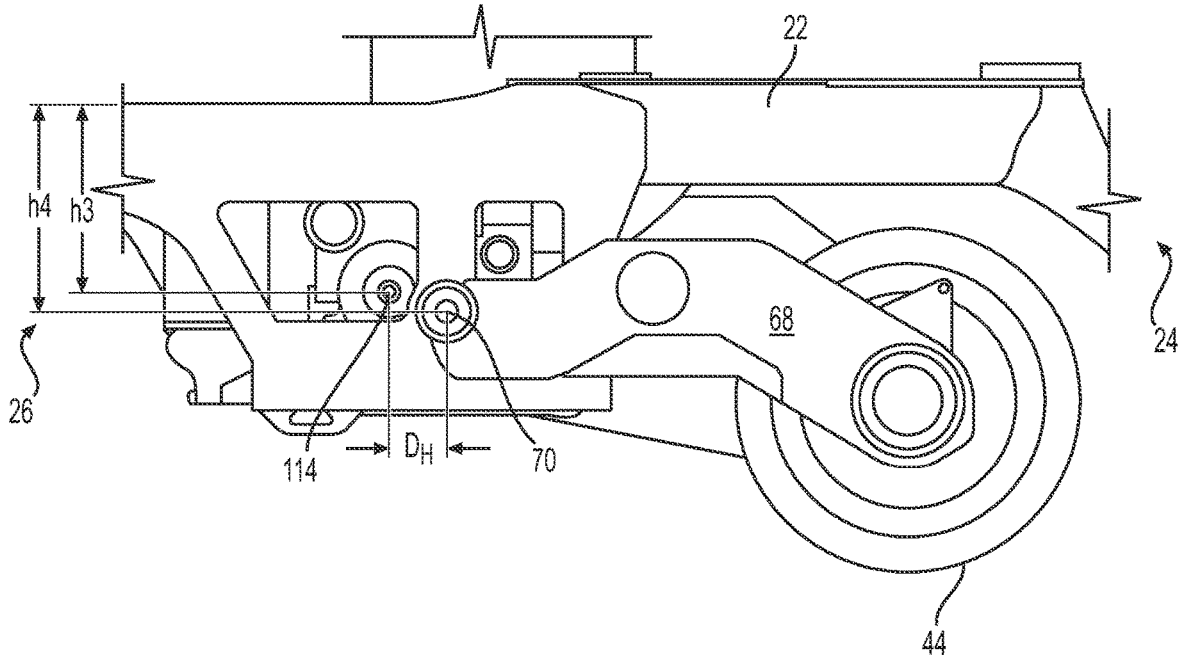
FIG. 5B is a partial view illustration of a right side of the exemplary milling machine of FIG. 1.

FIG. 5B illustrates a partial view of right side 64 of machine 20. As discussed above, output shaft axis 114 may be spaced apart from pivot axis 70 in both horizontal and vertical directions. For example, pivot axis 70 may be positioned forward of output shaft axis 114 by a horizontal distance "Mi." Pivot axis 70 may be also positioned vertically lower than output shaft axis 114. In one exemplary embodiment as illustrated in FIG. 5B, right arm 68 may not include transmission 116, although embodiments in which both left and right arms 66, 68 include transmissions 116 are contemplated. By placing transmission 116 on only left side 62 of machine 20, right arm 68 may have a smaller width than transmission casing 118, which may allow machine 20 to be positioned closer to embankments, walls, etc. on right side 64, thereby allowing milling drum 44 to make flush cuts on right side 64.

Figure 6A:
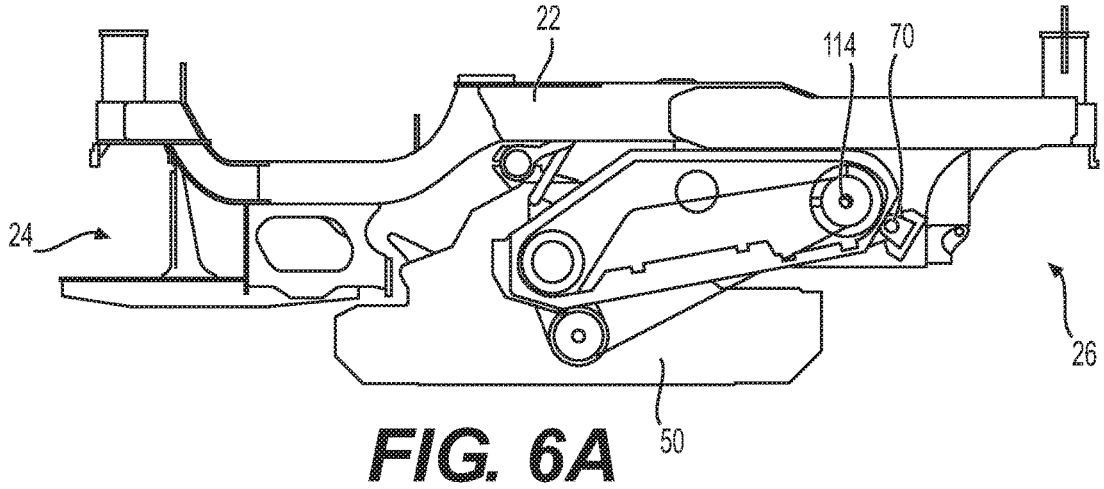
FIG. 6A is another partial view illustration of a left side of the exemplary milling machine of FIG. 1.
Figure 6B:
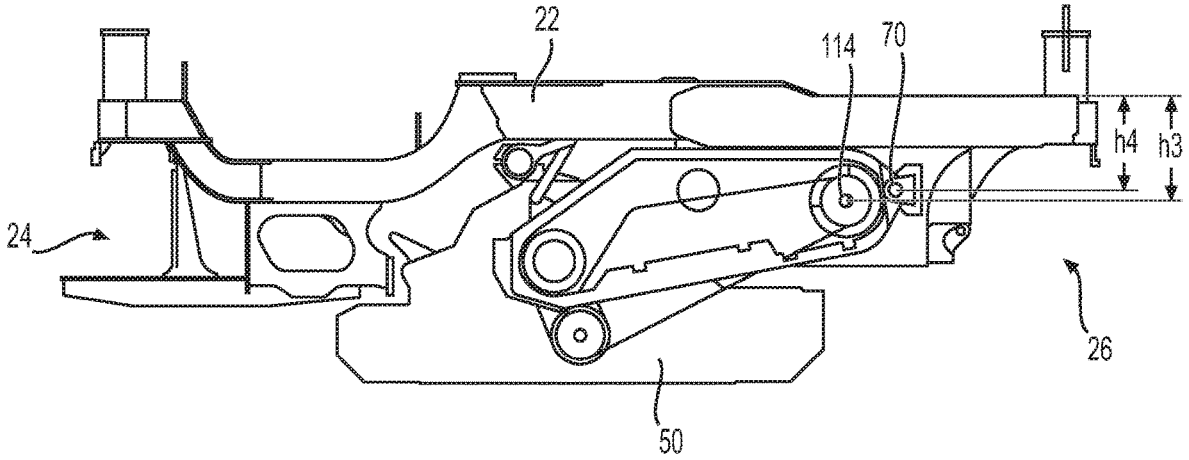
FIG. 6B is another partial view illustration of a right side of the exemplary milling machine of FIG. 1.

FIGS. 5A and 5B illustrate exemplary embodiments in which pivot axis 70 is positioned forward of output shaft axis 114 and offset towards ground surface 60 and away from frame 22. It is contemplated, however, pivot axis 70 may be positioned in front of or behind output shaft axis 114. Furthermore, pivot axis 70 may be positioned nearer to or further from frame 22 relative to output shaft axis 114. FIG. 6A illustrates a partial view of right side 64 of an exemplary machine 20 in which pivot axis 70 is positioned behind output shaft axis 114 (e.g. nearer rear end 26). Likewise, FIG. 6B illustrates a partial view of right side 64 of an exemplary machine 20 in which pivot axis 70 is not only positioned behind output shaft axis 114 but also located nearer frame 22 as compared to output shaft axis 114. For example, in FIG. 6B, pivot axis 70 is positioned at a height $h_4$ relative to frame 22 and rotational axis is positioned at a height $h_3$ relative to frame 22. Unlike the embodiment of machine 20 illustrated in FIGS. 5A and 5B, however, in the exemplary embodiment of FIG. 6B, height $h_3$ is greater than height $h_4$ so that output shaft axis 114 is disposed further away from frame 22 and nearer to ground surface 60 as compared to pivot axis 70.

Figure 7:
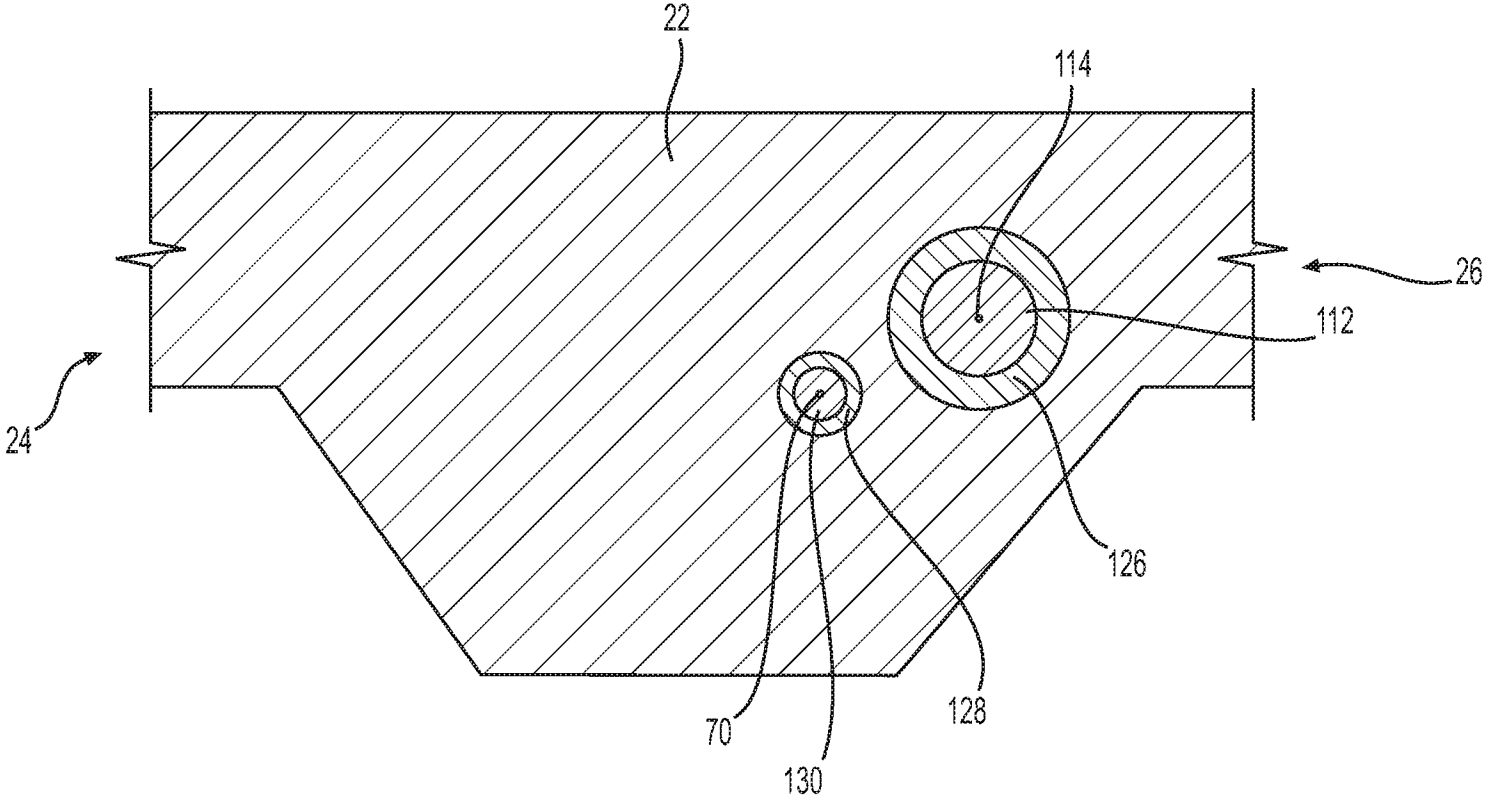
FIG. 7 is a partial cross-section view illustration of a portion of a frame of the exemplary milling machine of FIG. 1.

FIG. 7 illustrates a partial cross-section through a portion of frame 22 of an exemplary machine 20. In some exemplary embodiments as illustrated in FIG. 7, output shaft axis 114 of engine output shaft 112 is positioned offset from pivot axis 70. As also illustrated in FIG. 7, engine shaft bearing 126 may be attached to frame 22. In some exemplary embodiments, engine shaft bearing 126 may be a journal bearing, although other types of bearings are also contemplated. Engine shaft bearing 126 may support output shaft 112 of engine 56 or an axle of engine-driven pulley 120. Output shaft 112 may be configured to rotate within bearing 126. In other exemplary embodiments, engine shaft bearing 126 may not be attached to frame 22 but rather may be attached to another component of machine 20. In these exemplary embodiments, engine output shaft 112 may extend through an opening in frame 22 such that there may be a clearance between engine output shaft 112 and an inner surface of the opening.

Each of left and right arms 66, 68 may include shaft 130. As illustrated in FIG. 7, shaft 130 may be configured to rotate with arm bearing 128. Arm bearing 128 may be attached to frame 22. Like engine shaft bearing 126, arm bearing 128 may be a journal bearing or another type of bearing configured to support shaft 130. In one exemplary embodiment as illustrated in FIG. 7, arm bearing 128 may be smaller in size compared to engine shaft bearing 126.

Positioning pivot axis 70 separated from output shaft axis 114 instead of coaxial with output shaft axis 114 may provide several advantages. For example, offsetting output shaft 112 from pivot axis 70 may allow two for a relatively smaller size of arm bearing 128 instead of using one large bearing 126 configured to support shafts 130 of left and right arms 66, 68 and surround output shaft 112, which may pass through bearing 128. A coaxial arrangement of pivot axis 70 and output shaft axis 114 as in conventional machines typically requires the use of a custom bearing sized to support both left and right arms 66, 68 and allow output shaft 112 to pass through bearing 128. In contrast, separating the locations of pivot axis 70 and output shaft axis 114 may allow for the use of a generally smaller arm bearing 128, which may be a standard off-the shelf component making the disclosed design cheaper and easier to manufacture relative to the conventional machines. Offsetting pivot axis 70 from output shaft axis 114 may also help ensure ease of maintenance by allowing bearings 126, 128 to be assembled or disassembled, repaired, and/or replaced individually and when necessary. Offsetting pivot axis 70 from output shaft axis 114 may provide improved ease of access to engine 56 for maintenance or repair purposes. Additionally, offsetting pivot axis 70 from output shaft axis 114 may provide greater freedom of placement of engine 56 on frame 22, allowing for improved control of the center of mass of machine 20.

It will be apparent to those skilled in the art that various modifications and variations can be made to the disclosed milling machine. Other embodiments will be apparent to those skilled in the art from consideration of the specification and practice of the disclosed milling machine. It is intended that the specification and examples be considered as exemplary only, with a true scope being indicated by the following claims and their equivalents.

What is claimed is:

1. A milling machine, comprising:

a frame extending from a first end to a second end along a longitudinal direction;

a first wheel and a second wheel connected to the first end of the frame;

a third wheel connected to the second end of the frame;

a first leg connecting the frame and the first wheel;

a second leg connecting the frame and the second wheel;

a third leg connecting the frame and the third wheel;

a pair of arms pivotably connected to opposite sides of the frame, the arms having a pivot axis disposed transverse to the longitudinal direction of the frame;

a milling drum rotatably connected to free ends of the pair of arms, a rotational axis of the milling drum being disposed generally parallel to the pivot axis;

an engine configured to rotate the milling drum via a transmission, the engine having an output shaft positioned generally transverse to the frame, the output shaft having an output shaft axis disposed spaced apart from the pivot axis of the arms;

wherein the pivot axis is disposed between the output shaft axis and the rotational axis of the milling drum along a travel direction of the machine.

2. The milling machine of claim 1, wherein the output shaft axis is disposed generally parallel to the pivot axis of the arms.

3. The milling machine of claim 1, wherein the output shaft is disposed generally inclined relative to the pivot axis of the arms.

4. The milling machine of claim 1, wherein the arms extend in a direction from a rear of the milling machine towards a front of the milling machine.

5. The milling machine of claim 1, further including an arm bearing attached to the frame and configured to support a shaft associated with one of the arms.

6. The milling machine of claim 1, wherein the pivot axis is positioned at a first height relative to the frame, and the output shaft axis is positioned at a second height relative to the frame.

7. The milling machine of claim 6, wherein the first height is smaller than the second height.

8. The milling machine of claim 6, wherein the first height is larger than the second height.

9. The milling machine of claim 1, wherein the transmission includes:

an engine-driven pulley connected to the output shaft of the engine;

a drum pulley connected to the milling drum; and at least one belt connecting the engine-driven pulley and the drum pulley.

10. The milling machine of claim 9, wherein one of the pair of arms includes a transmission casing that encloses the engine-driven pulley, the drum pulley, and the at least one belt.

11. The milling machine of claim 1, further including an operator platform disposed between the first end and the second end of the frame, the operator platform being configured to be movable from adjacent a first side of the frame to a second side of the frame.

12. The milling machine of claim 1, wherein at least one of the first leg, the second leg, or the third leg, includes:

an upper section connected to the frame;

a lower section connected to a respective one of the first, second, or third wheel, the upper and lower sections being movable relative to each other; and an actuator connected at one end to the frame and at an opposite end to the lower section.

13. The milling machine of claim 1, further including a cross tube connecting the pair of arms; and at least one arm actuator connected at one end to the frame and at an opposite end to the cross tube.

14. A milling machine, comprising:

a frame extending from a front end to a rear end along a longitudinal direction;

a left front wheel disposed adjacent the front end of the frame;

a right front wheel disposed adjacent the front end and spaced apart from the left front wheel;

a left rear wheel disposed adjacent the rear end of the frame;

a right rear wheel disposed adjacent the rear end and spaced apart from the left rear wheel;

a left front leg connecting the frame and the left front wheel;

a right front leg connecting the frame and the right front wheel;

a left rear leg connecting the frame and the left rear wheel;

a right rear leg connecting the frame the right rear wheel;

a left arm pivotably connected to the frame and extending from the frame towards the front end of the frame;

a right arm pivotably connected to the frame and extending from the frame towards the front end of the frame, the left arm and the right arm having a pivot axis disposed transverse to the longitudinal direction of the frame;

a cross tube connecting the left arm and the right arm;

at least one arm actuator connecting the frame and the cross tube;

a milling drum rotatably connected to free ends of the left and right arms;

an engine disposed transverse to the frame and having an output shaft configured to rotate the milling drum via a belt drive, an output shaft axis of the output shaft being disposed parallel to and spaced apart from the pivot axis;

wherein the pivot axis is disposed between the output shaft axis and a rotational axis of the milling drum along a travel direction of the machine.

15. The milling machine of claim 14, wherein the belt drive is disposed on one side of the frame and includes:

an engine-driven pulley connected to the output shaft of the engine;

a drum pulley connected to the milling drum; and at least one belt connecting the engine-driven pulley and the drum pulley.

16. The milling machine of claim 14, further including an operator platform disposed between the front end and the rear end of the frame, the operator platform being configured to be movable from adjacent a first side of the frame to a second side of the frame.

17. The milling machine of claim 14, wherein the pivot axis is positioned at a first height relative to the frame, and the output shaft axis is positioned at a second height relative to the frame.

18. The milling machine of claim 17, wherein the first height is smaller than the second height.

19. The milling machine of claim 17, wherein the first height is larger than the second height.

20. The milling machine of claim 14, further including an arm bearing attached to the frame and configured to support a shaft associated with one of the arms.

* * * * *